United States Patent [19]

Pennanen

[11] 4,164,315

[45] Aug. 14, 1979

[54] BLANK FOR BOXES

[75] Inventor: Paavo Pennanen, Inkeroinen, Finland

[73] Assignee: Oy Tampella AB

[21] Appl. No.: 914,742

[22] Filed: Jun. 8, 1978

[30] Foreign Application Priority Data

Aug. 12, 1977 [FI] Finland ..... 773713

[51] Int. Cl.[2] ..... B65D 5/22

[52] U.S. Cl. ..... 229/34 R

[58] Field of Search ..... 229/34 R

[56] References Cited

U.S. PATENT DOCUMENTS

| | | | |
|---|---|---|---|
| 1,513,608 | 10/1924 | Labombarde | 229/34 R |
| 2,828,059 | 3/1958 | Ross | 229/34 R |
| 2,931,556 | 4/1960 | Muise | 229/34 R |
| 3,580,475 | 5/1971 | Mobley | 229/34 R |
| 3,685,718 | 8/1972 | Chidgey | 229/34 R |
| 3,820,706 | 6/1974 | Gibson et al. | 229/34 R |
| 3,887,126 | 6/1975 | Wilson | 229/34 R |
| 3,899,121 | 8/1975 | Herbetko | 229/34 R |
| 3,910,484 | 10/1975 | Wozniacki | 229/34 R |

*Primary Examiner*—Davis T. Moorhead

*Attorney, Agent, or Firm*—Steinberg & Blake

[57] ABSTRACT

A blank formed of cardboard, corrugated board or other sheetlike material for forming stackable boxes. Upon folding, the blank provides wedge shaped end walls which extend above the side walls for engagement within a wedge shaped groove defined at the end edges of the bottom wall of another box similarly formed located in stacked relationship to the first box.

8 Claims, 3 Drawing Figures

BLANK FOR BOXES

BACKGROUND OF THE INVENTION

This invention relates to a blank for making a box of carboard, corrugated board or other sheetlike material and, more particularly, to a blank for making boxes which can be stacked upon similar boxes.

Blanks for forming stackable boxes are known. In one such construction, inner and outer end pieces define a narrow, vettical opening, the box also being provided with an upwardly extending flap. The size of the vertical opening is such that the flap in the lower box is pushed into the narrow opening of the upper box upon stacking. In particular, an opening is defined between the bottom and end wall of the box, an upwardly extending flap being formed by a suitable cut in extensions integrally formed with the end wall. The boxes are constructed by folding side wall extensions which are shorter than the bottom of the box along straight creases which define the extension. Thereafter, the end walls of the boxes together with the extensions thereof are folded over the folded extensions of the side walls, whereby the end walls form the outer end of the box and the end wall extensions form the inner ends of the box. The upwardly extending flap formed in the extensions of the end wall serve to lock the end construction in the opening defined between the bottom and end walls of a box stacked over the lower box.

However, stackable boxes typified by the construction described hereinabove have been found to be not entirely satisfactory. In the case of the structure described hereinabove, the upwardly extending flaps must be precisely manually guided into the narrow openings in the end construction of the boxes upon stacking. Further, it has been found that boxes formed according to prior art techniques can not be reliably stacked, i.e., such an assembly of stacked boxes have been found to be not entirely stable.

SUMMARY OF THE INVENTION

Accordingly, one object of the present invention is to provide a new and improved blank for forming boxes.

Another object of the present invention is to provide a new and improved blank for forming stackable boxes.

Still another object of the present invention is to provide a new and improved blank for boxes providing an end construction for engagement with similarly formed boxes so that such boxes can be stacked in a reliable manner.

Briefly, these and other objects are attained by providing a blank including a bottom wall forming portion, a pair of side wall forming portions, and a pair of end wall forming portions, constructed as follows. The side wall forming portions of the box are longer than the bottom wall forming portions, side wall extensions being provided on the ends of the side wall forming portions defined by creases which are oblique with respect to the side walls. The end wall forming portions as provided with first extensions, the end wall forming portions and such first extensions being broader than the side walls. The side wall extensions are folded along the oblique creases against the back or outwardly facing surface of the end wall forming portions. The first end wall extensions are folded to engage the back of the side wall extensions so that the end wall forming portions and the first extensions thereof form an upwardly extending wedgelike structure extending over the upper edges of the side walls for stacking. The end wall forming portions and the first extensions thereof are locked into position by means of second and third end wall extensions which are folded into the upwardly converging space formed between the end wall forming portion and the first extention thereof. The second and third end wall extensions define upwardly facing wedgelike stacking grooves at the end edges of the bottom wall of the box. The second and third end wall extensions are securely locked in position by means of locking tabs provided at the ends edges of the bottom wall forming portion of the box.

DETAILED DESCRIPTION OF PREFERRED EMBODIMENTS

Figure 1:
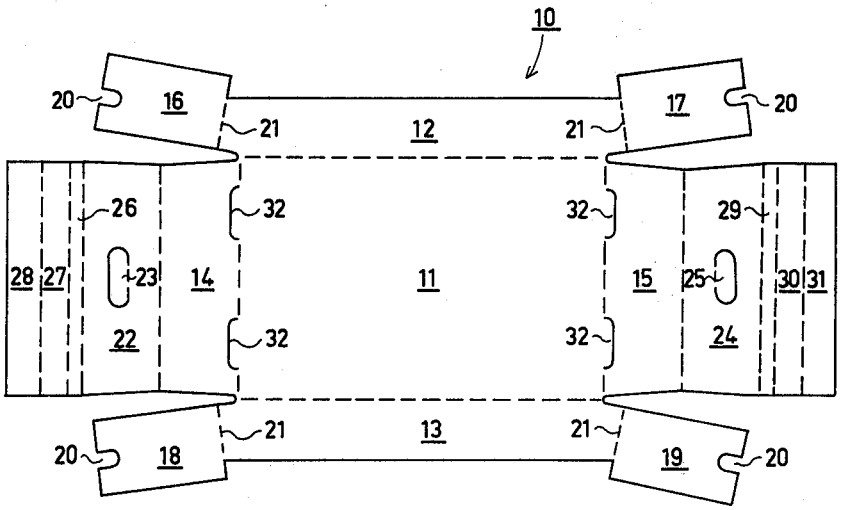
FIG. 1 is a plan view of a blank for forming a box according to the present invention.

Referring now to the drawings wherein like reference characters designate identical or corresponding parts throughout the several views, and more particularly in FIG. 1, a blank 10 formed of cardboard, corrugated board or similar sheet material comprising one embodiment of the present invention is shown. It is understood that the dashed lines in the drawings indicate creases formed in the sheet material to facilitate folding thereof. The blank 10 comprises a generally rectangular bottom wall forming portion 11 integrally formed with side wall forming portions 12 and 13 extending along the side edges of the bottom wall forming portion 11. Side wall forming portion 12 has a pair of side wall extensions 16, 17 formed at its ends while side wall forming portion 13 has corresponding side wall extensions 18, 19 similarly provided. It is noted that the side wall extensions 16, 17, 18 and 19 are partially defined by creases 21 which are oblique with respect to the side wall forming portions 12 and 13 and which extend at right angles with respect to the longer edges of the side wall extensions 16–19.

Integrally formed with and extending from the end edges of bottom wall forming portion 11 are end wall forming portions 14, 15. Material is removed from the edges of the end wall forming portions 14 and 15 so that upon folding, the resulting end walls defined by end wall forming portions 14 and 15 converge upwardly. Thus, wedgelike openings are defined between end wall forming portions 14 and 15 and side wall extensions 16–19. Additionally, side wall extensions 16–19 are preferably broader or wider than side wall forming portions 12 and 13. The short, outwardly facing edges of side wall extensions 16–19 are provided with curved notches, the function of which will be explained in detail hereinbelow.

The end wall forming portions 14, 15 have first end wall extensions 22, 24, respectively, integrally formed thereon. Material is removed from the edges of first end wll extensions 22, 24 so that upon folding as described below, these edges are upwardly converging. Openings 23 and 25 are formed in first end wall extensions 22, 24 respectively, the function of which will be described below.

Second end wall extensions 27, 30 are integrally formed with the first end wall extensions 22, 24, respectively and, additionally, third end wall extensions 28, 31 are integrally formed with second end wall extensions 27, 30 respectively. The second end wall extensions 27, 30 and third end wall extensions 28, 31 are preferably slightly shorter than the width of bottom wall forming portion 11. Narrow strips of material, designated 26, 29 are defined in the present embodiment between first end wall extensions 22, 24 and second end wall extensions 27, 30, each such strip being defined by a pair of parallely extending creases. The strips 26 and 29 facilitate folding of the blank 10 when the material of which the blank is formed is relatively thick, e.g., when the blank is formed of corrugated board. However, it is understood that when the blank material is relatively thin, strips 26 and 29 are not necessary. Locking tabs 32 are formed along the end edges of the bottom wall forming portion 11 for purposes discussed hereinbelow.

In construction, the end wall forming portions 14 and 15, together with the respective first, second and third end wall extensions 22, 27, 28 and 24, 30 and 31, respectively, are folded upwardly with respect to bottom wall forming portion 11 at right angles thereto. Thereafter, side wall forming portions 12 and 13 are upwardly folded and side wall extension 16–19 are thereafter folded along oblique creases 21 against the back or outwardly facing surface of the end wall forming portions 14 and 15 so that the side wall extensions 16 and 18 and, correspondingly, side wall extensions 17 and 19 are paired against respective ones of end wall forming portions 14 and 15. Thereafter, the first end wall extensions 22 and 24 are folded over the pairs of side wall extensions 16, 18, and 17, 19, respectively, to define the outer end walls of the box.

Figure 3:
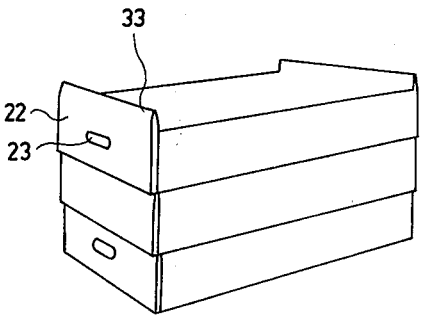
FIG. 3 is a perspective view of a plurality of boxes constructed according to the present invention in stacked relationship.

In this manner, the end wall 14 and the first end wall extension 22 thereof as well as the end wall 15 and the first end wall extension 24 thereof form a pair of upwardly extending wedgelike structures 33 (FIG. 3). These raised structures cooperate with grooves, described below, to facilitate stacking as shown in FIG. 3.

The end structure of the box defined by end wall 14 and first end wall extension 22 on the one side and end wall forming portion 15 and first end wall extension 24 on the other side are locked into position by means of the second and third end wall extensions 27, 28 and 30, 31. More particularly, an upwardly converging space is defined at each end of the box between end wall forming portions 14, 15 and the first extensions thereof 22, 24. Thus, referring to the left hand end of the box in FIG. 2, the second and third end wall extensions 27, 28 are folded into the space defined between end wall forming portion 14 and first end wall extension 22. Similarly, referring to the right end of the box shown in FIG. 2, the second and third end wall extensions 30, 31 are folded into the space defined between end wall forming portion 15 and first end wall extension 24. The second and third end wall extensions are folded inwardly into the converging space to define stacking grooves 34 (FIG. 2) at the end edges of the bottom wall of the box. Stacking grooves 34 have a shape corresponding to the raised structure 33 to facilitate stacking. The grooves extend along substantially the entire width of the formed box as do raised structures 33 to improve stability and reliability in stacking.

Figure 2:
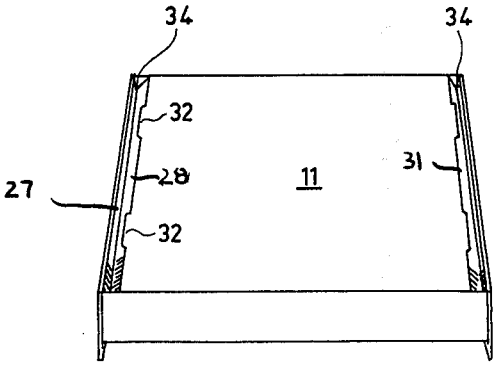
FIG. 2 is a perspective view of the bottom and side of a box formed from a blank according to the present invention.

The second and third end wall extensions 27, 28 and 30, 31 are locked into position as shown in FIG. 2 by means of locking tabs 32 formed along the end edges of bottom wall forming portion 11. Such locking tabs extend over the outer edge of the third end wall extensions 28, 31 to lock the same.

As mentioned hereinabove, first end wall extensions 22, 24 are provided with openings 23, 25 which, as is now apparent, function as handles upon forming the box. Notches 20 provided in side wall extensions 16–19 overlap openings 23 and 25 so as not to obstruct the handle forming openings.

From the above, it is readily seen that the present invention provides a blank for forming boxes which have upwardly extending wedgelike locking structures 33 which cooperate with wedgelike grooves 34 correspondingly formed adjacent the end edges of bottom wall forming portion 11 for reliably stacking the boxes so formed. It is understood that several of the features described in connection with the preferred embodiment need not be provided in box structures manufactured according to the present invention. For example, openings 23 and 25 are not essential, especially in the case of small boxes.

Obviously, numerous modifications in variations of the present invention are possible in the light of the above teachings. It is therefore to be understood that within the scope of the appended claims the invention may be practiced otherwise than as specifically described herein.

What is claimed is:

1. A blank for forming a stackable box formed of cardboard, corrugated board or the like comprising:

a bottom wall forming portion having side and end edges;

a pair of side wall forming portions integrally formed with and extending from the side edges of said bottom wall forming portion, said side wall forming portions being longer than the bottom wall forming portion;

a pair of side wall extensions extending from the ends of each of said sidewall forming portions, each of said said wall extensions being joined to a respective side wall forming portion by a crease extending obliquely with respect to the side wall forming portions;

a pair of end wall forming portions integrally formed with and extending from the edges of said bottom wall forming portion, said end wall forming portions being broader than the side wall forming portions;

a pair of first end wall extensions, each extending from and integrally formed with a respective end wall forming portion, said first end wall extensions being broader than the side wall forming portions;

a pair of second end wall extensions, each extending from and integrally formed with a respective first end wall extension; and a pair of third end wall extensions, each extending from and integrally formed with a respective second end wall extension;

whereby said end wall forming portions are folded upwardly, said side wall extensions are folded along said oblique creases to the back of said end wall forming portions and said first end wall extensions are folded downwardly to the back of said side wall extensions thereby forming the ends of the box, said side wall forming portions, said end wall forming portions and said first end wall extensions defining upwardly extending wedgelike stacking structures, said second and third end wall extensions are folded and locked into the upwardly converging spaces formed by said end wall forming portions and said first end wall extensions thereby forming upwardly extending wedgelike stacking grooves at the end edges of the bottom wall forming portion.

2. A blank as recited in claim 1 further including locking tabs formed along the end edges of said bottom wall forming portion, whereby said third end wall extensions are locked into position in said upwardly converging space thereby.

3. A blank as recited in claim 1 wherein the edges of said end wall forming portions and said first end wall extensions are shaped so as to be upwardly converging upon folding.

4. A blank as recited in claim 1 further comprising strip portions defined by a pair of creases between said first and second end wall extensions, said strip being at least as broad as the thickness of the side wall extensions.

5. A blank as recited in claim 1 wherein said second and third end wall extensions are slightly shorter than the end edges of the bottom wall forming portion.

6. A blank as recited in claim 1 wherein said side wall extensions are broader than the side wall forming portions.

7. A blank as recited in claim 1 wherein said first end wall extensions are each provided with an opening formed therethrough.

8. A blank as recited in claim 7 wherein notches are formed in the edges of said side wall extensions adapted to overlap said openings upon folding.

* * * * *